US006686688B2

(12) United States Patent
Fukuda

(10) Patent No.: US 6,686,688 B2
(45) Date of Patent: Feb. 3, 2004

(54) COLOR CATHODE-RAY TUBE APPARATUS

(75) Inventor: Yutaka Fukuda, Kumagaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 427 days.

(21) Appl. No.: 09/741,012

(22) Filed: Dec. 21, 2000

(65) Prior Publication Data

US 2001/0005113 A1 Jun. 28, 2001

(30) Foreign Application Priority Data

Dec. 22, 1999 (JP) ..... 11-364548

(51) Int. Cl.[7] ..... H01J 29/76

(52) U.S. Cl. ..... 313/440; 313/433; 335/212; 335/217

(58) Field of Search ..... 313/433, 440, 313/431, 413; 335/210, 212, 217

(56) References Cited

U.S. PATENT DOCUMENTS 3,573,525 A * 4/1971 Fuse ..... 313/431
3,714,495 A * 1/1973 Boekhorst ..... 315/368.18
3,946,266 A * 3/1976 Saito et al. ..... 313/442
3,980,925 A * 9/1976 Awata et al. ..... 315/370
5,444,338 A * 8/1995 George et al. ..... 315/371
5,491,389 A * 2/1996 Fernsler et al. ..... 315/371
5,548,190 A * 8/1996 Okuyama et al. ..... 315/368.26
5,668,447 A * 9/1997 Okuyama et al. ..... 315/368.26
5,719,542 A * 2/1998 Park et al. ..... 335/213
6,160,363 A * 12/2000 Sugimoto et al. ..... 315/368.28
6,366,034 B1 * 4/2002 Kwon et al. ..... 315/368.25
2002/0057047 A1 * 5/2002 Nakajima ..... 313/440

FOREIGN PATENT DOCUMENTS

JP 10-50238 2/1998

* cited by examiner

*Primary Examiner*—Jay Patidar
(74) *Attorney, Agent, or Firm*—Pillsbury Winthrop LLP

(57) ABSTRACT

A color cathode-ray tube apparatus has a compensation mechanism for generating a magnetic field that compensates a change in a horizontal-deflection magnetic field due to a change in the temperature of horizontal-deflection coils. The compensation mechanism is formed of auxiliary coils to which a current is supplied in synchronism with horizontal deflection of electron beams, and a control element for controlling the current supplied to the auxiliary coils in accordance with a change in the temperature of the horizontal-deflection coils.

11 Claims, 5 Drawing Sheets

COLOR CATHODE-RAY TUBE APPARATUS

CROSS-REFERENCE TO RELATED APPLICATIONS

This application is based upon and claims the benefit of priority from the prior Japanese Patent Application No. 11-364548, filed Dec. 22, 1999, the entire contents of which are incorporated herein by reference.

BACKGROUND OF THE INVENTION

This invention relates to a color cathode-ray tube apparatus, and more particularly to an in-line color cathode-ray tube apparatus having a structure for compensating variations in the convergence of a pair of side beams due to variations in the temperature of a deflection yoke.

An electron-gun assembly used in the in-line color cathode-ray tube apparatus emits three electron beams in line, i.e. a central beam and a pair of side beams that pass on a single plane. This type of color cathode-ray tube apparatus is designed to converge three electron beams 5R, 5G and 5B on the central point C of a phosphor screen 8 by means of an electron lens installed in the electron gun assembly 4 and a magnetic field generated by a PCM (Purity Convergence Magnet) 10 provided on the outer surface of an envelope, as is shown in FIG. 8.

Since, however, the distance from the electron gun assembly 4 to a peripheral portion P of the phosphor screen 8 is longer than the distance therefrom to the central point, the pair of side beams 5G and 5B converge in front of the phosphor screen 8 and not on it when they are directed to the peripheral portion P.

Accordingly, in the color cathode-ray tube apparatus that emits the three electron beams 5R, 5G and 5B in line, the three electron beams 5R, 5G and 5B are deflected in a horizontal direction (X direction) by a pincushion shape horizontal-deflection magnetic field 13 generated by a pair of upper and lower horizontal-deflection coils 12*a* and 12*b* that constitute a deflection yoke, as is shown in FIG. 9. In this structure, different deflection forces F are applied to the side beams 5R and 5B directed to the peripheral portion P, thereby converging the beams on the peripheral portion P as indicated by the broken lines in FIG. 8.

Concerning a display tube used increasingly for, for example, information device terminals, the horizontal-deflection frequency is being increased to satisfy a demand for higher definition.

However, the higher the horizontal-deflection frequency, the greater the heat generation of the horizontal-deflection coils, resulting in various problems due to an increase in the temperature of the deflection yoke. In particular, in the horizontal-deflection coils, the pincushion shape deflection magnetic field changes into a barrel shape due to thermal expansion of the coils. As a result, the degree of crossover of the pair of side beams increases at left and right portions of the screen, whereby misconvergence Xh occurs in which a red pattern 15R is displaced to the left from a blue pattern 15B as shown in FIG. 10, thereby degrading the quality of an image.

Japanese Patent Application KOKAI Publication No. 10-50238 discloses, as means for compensating misconvergence Xh of a pair of side beams, compensation means that comprises a diode bridge connected to horizontal-deflection coils, and a pair of correction coils connected parallel to each other and also connected to the diode bridge via a variable coil. This compensation means is, however, for compensating misconvergence due to variations in the process of manufacturing deflection coils, and hence cannot compensate for misconvergence that occurs after a color cathode-ray tube apparatus is assembled.

BRIEF SUMMARY OF THE INVENTION

The present invention has been developed to solve the above-described problem and aims to provide a color cathode-ray tube apparatus capable of compensating misconvergence of a pair of side beams due to a change in the temperature of a deflection yoke incorporated therein.

To attain the aim, there is provided a color cathode-ray tube apparatus having a pair of horizontal-deflection coils for generating a horizontal-deflection magnetic field that horizontally deflects a plurality of electron beams emitted from an electron gun assembly, comprising:

compensation means for generating a magnetic field that compensates a change in the horizontal-deflection magnetic field due to a change in a temperature of the horizontal-deflection coils, the compensation means having auxiliary coils to which a current is supplied in synchronism with horizontal deflection of the electron beams, and a control element for controlling the current supplied to the auxiliary coils in accordance with a change in the temperature of the horizontal-deflection coils.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Color cathode-ray tube apparatuses according to the embodiments of the invention will be described in detail with reference to the accompanying drawings.

Figure 1:
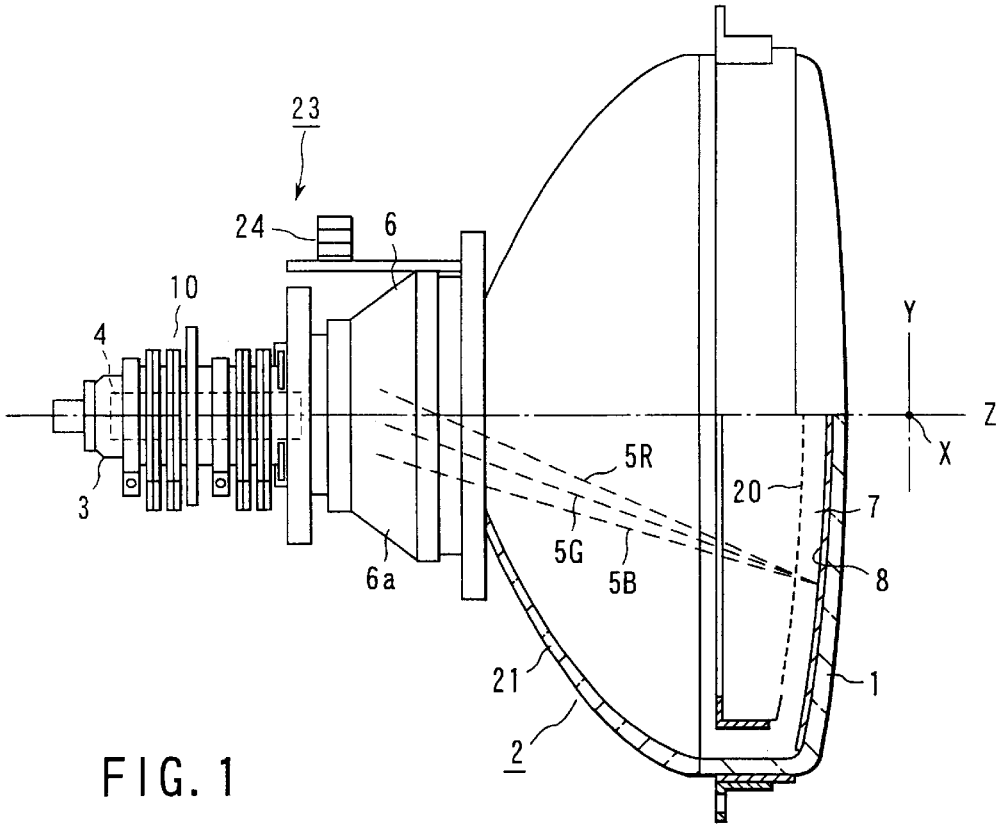
FIG. 1 is a fragmentary sectional view illustrating the structure of a color cathode-ray tube apparatus according to an embodiment of the invention.

As shown in FIG. 1, a color cathode-ray tube apparatus according to a first embodiment has an envelope formed of a panel 1 and a funnel 2 connected thereto. A phosphor screen 8 includes three-color phosphor layers arranged in dots or stripes and emitting blue, green and red light. The phosphor screen 8 is provided on the inner surface of the panel 1. A shadow mask 7 has multiple electron-beam-passing holes and is provided on a surface 20 opposed to the phosphor screen 8.

The color cathode-ray tube apparatus also includes an in-line electron gun assembly 4 located in the neck 3 of the funnel 2. The electron gun assembly 4 emits three electron beams 5 (R, G, B) in line. Specifically, the beams 5 consist of a central beam 5G and a pair of side beams 5B and 5R that pass on a single plane.

A deflection yoke 6 extends from a large-diameter section 21 included in the funnel 2 to the neck 3. The deflection yoke 6 has a core section 6*a* made of a magnetic material. The deflection yoke 6 has a pair of upper and lower horizontal-deflection coils 12*a* and 12*b* for generating a horizontal-deflection magnetic field of a pincushion shape that deflects, in the horizontal direction (i.e. in the X direction), the three electron beams 5 (R, G, B) emitted from the electron gun assembly 4. The deflection yoke 6 also has vertical-deflection coils for generating a vertical-deflection magnetic field of a barrel shape that deflects the three electron beams 5 (R, G, B) in the vertical direction (i.e. in the Y direction).

The color cathode-ray tube apparatus further includes a PCM (Purity Convergence Magnet) 10 provided on the outer surface of the neck 3 behind the deflection yoke 6 for generating a quadrupole or six-pole magnetic field.

The PCM 10 adjusts the three electron beams 5 (R, G, B) so that they converge on a central portion of the screen of the apparatus, i.e. the phosphor screen 8. While the three electron beams 5 (R, G, B) are scanned over the entire screen, they are deflected in the horizontal (X) and vertical (Y) directions by a non-uniform magnetic field that consists of a pincushion shape horizontal-deflection magnetic field and a barrel shape vertical-deflection magnetic field generated from the deflection yoke 6.

In the color cathode-ray tube apparatus, misconvergence of the electron beams will occur due to a change in the shape of the magnetic field caused by thermal expansion of the deflection coils resulting from a change in the temperature of the deflection yoke 6. In particular, in a display tube having its horizontal deflection frequency increased to satisfy a request for higher definition, large misconvergence will occur because of thermal expansion of the horizontal-deflection coils due to their own heat generation.

To avoid this, the deflection yoke 6 incorporated in the color cathode-ray tube apparatus of this embodiment has a compensation mechanism 23 for compensating misconvergence due to a change in the temperature of the horizontal-deflection coils. As shown, for example, in FIGS. 2 and 3, the compensation mechanism 23 comprises a pair of auxiliary coils 25*a* and 25*b* through which current flows in synchronism with horizontal deflection, and a control element 24 for controlling the current flowing through the auxiliary coils 25*a* and 25*b* in accordance with a change in the temperature of the horizontal-deflection coils 12*a* and 12*b*.

Figure 2:
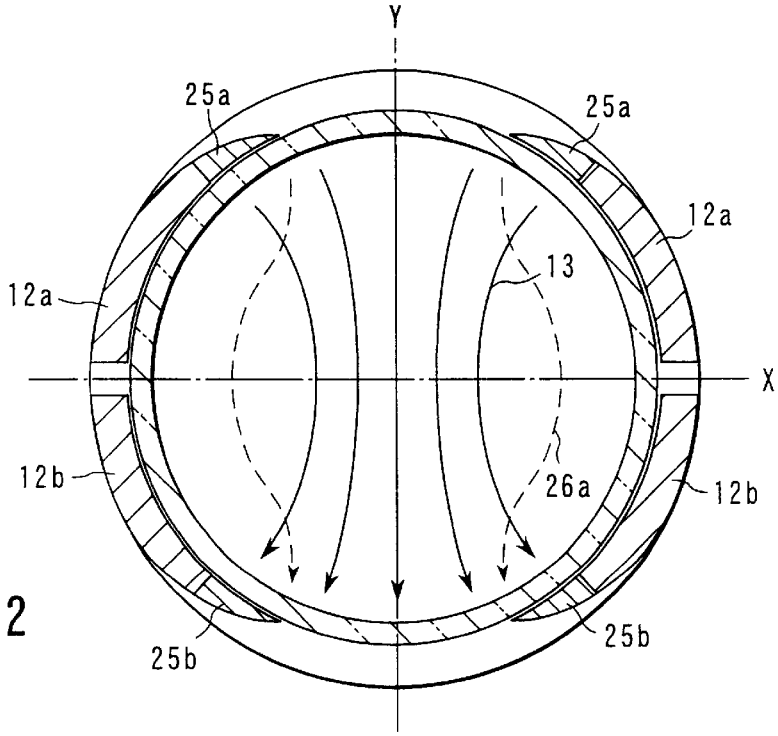
FIG. 2 is a sectional view illustrating the structure of a deflection yoke having a compensation mechanism and incorporated in the color cathode-ray tube apparatus of FIG. 1.
Figure 3:
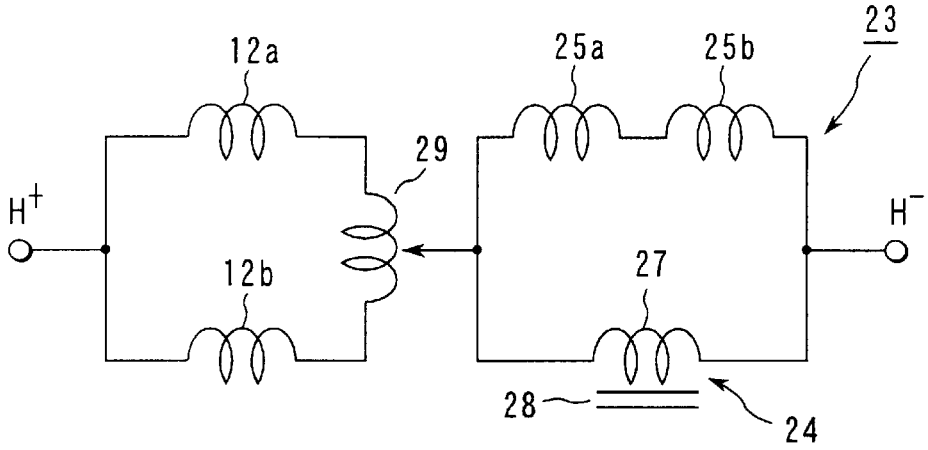
FIG. 3 is a circuit diagram showing the compensation mechanism incorporated in the deflection yoke of FIG. 2.

As shown in FIGS. 2 and 3, the auxiliary coils 25*a* and 25*b* are provided adjacent to the horizontal-deflection coils 12*a* and 12*b*, respectively, close to the vertical axis, i.e. the Y-axis, of the coils 12*a* and 12*b*. While the horizontal-deflection coils 12*a* and 12*b* generate a pincushion shape horizontal-deflection magnetic field 13, the auxiliary coils 25*a* and 25*b* generate a barrel shape magnetic field 26*a*. The auxiliary coils 25*a* and 25*b* and the horizontal-deflection coils 12*a* and 12*b* appropriately adjust the forces applied to a pair of side beams. In other words, these coils generate a magnetic field that prevents misconvergence from occurring at left and right portions of the screen.

The control element 24 is provided outside the deflection yoke 6 as shown in FIG. 1, and is an inductance element including a coil 27 and a magnetic core 28 as shown in FIG. 3. The magnetic core 28 of the control element 24 is made of a magnetic material that shows a larger change in magnetic permeability than the magnetic material of the core 6*a* of the deflection yoke 6 when the temperature changes.

The auxiliary coils 25*a* and 25*b* are connected parallel to the control element 24 as shown in FIG. 3. The compensation mechanism 23 is connected to the horizontal-deflection coils 12*a* and 12*b* via a differential coil 29 interposed therebetween.

In the color cathode-ray tube apparatus having the compensation mechanism 23 constructed as the above, misconvergence of a pair of side beams can be compensated, which will occur when the shape of the horizontal-deflection magnetic field changes because of thermal expansion of the horizontal-deflection coils 12*a* and 12*b* due to an increase in the temperature of the deflection yoke 6.

Specifically, when the horizontal-deflection coils 12*a* and 12*b* have thermally expanded because of a temperature increase, the pincushion shape horizontal-deflection magnetic field 13 generated by the horizontal-deflection coils 12*a* and 12*b* weakens and changes into a shape relatively similar to the barrel-shape field. Accordingly, the difference between the forces of the horizontal-deflection magnetic field 13 applied to the side beams reduces, thereby increasing the degree of misconvergence Xh. At this time, the magnetic permeability of the magnetic core 28 of the control element 24 reduces because of the temperature increase, and hence the inductance of the element 24 reduces.

As a result, the impedance of the control element 24 reduces, and a horizontal-deflection current flowing into the element 24 increases. On the other hand, a current flowing into the auxiliary coils 25*a* and 25*b* connected parallel to the control element 24 reduces. Accordingly, the barrel-shape magnetic field 26*a*, shown in FIG. 2, generated by the auxiliary coils 25*a* and 25*b* weakens and changes into a shape relatively similar to the pincushion shape. As a result, the magnetic field generated by the auxiliary coils 25*a* and 25*b* compensates the weakened pincushion-shape horizontal-deflection magnetic field 13 generated by the horizontal-deflection coils 12*a* and 12*b* such that the difference between the forces applied to the pair of side beams becomes appropriate. Thus, misconvergence Xh of the side beams is compensated.

As described above, misconvergence of the side beams can be prevented, even when the horizontal-deflection coils 12*a* and 12*b* have thermally expanded due to a temperature increase, by constructing the deflection yoke 6 such that a magnetic field obtained by synthesizing, at a normal temperature, the horizontal-deflection magnetic field 13 generated by the horizontal-deflection coils 12*a* and 12*b* and the magnetic field 26*a* generated by the auxiliary coils 25*a* and 25*b* will appropriately converge a pair of side beams on a horizontal peripheral portion of the screen.

Although, in the above-described embodiment, the auxiliary coils 25*a* and 25*b* are formed integral with or close to the horizontal-deflection coils 12*a* and 12*b* as shown in FIG. 2, they may be separated from the horizontal-deflection coils 12*a* and 12*b* and located closer to the vertical axis (Y-axis), or may be located closer to the horizontal axis (X-axis) than in the case of FIG. 2. It is sufficient if a magnetic field is synthesized, which will appropriately converge a pair of side beams on a horizontal peripheral portion of the screen.

A description will now be given of another compensation mechanism for use in the color cathode-ray tube apparatus of the invention.

Figure 4:
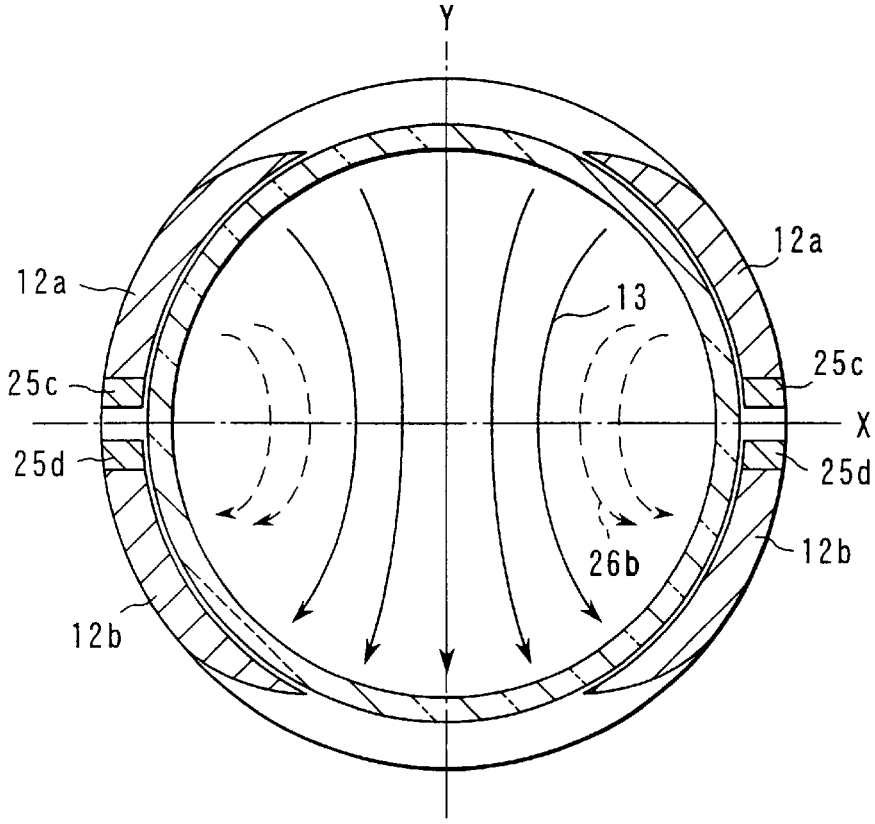
FIG. 4 is a sectional view illustrating a deflection yoke having a compensation mechanism, according to another embodiment of the invention.
Figure 5:
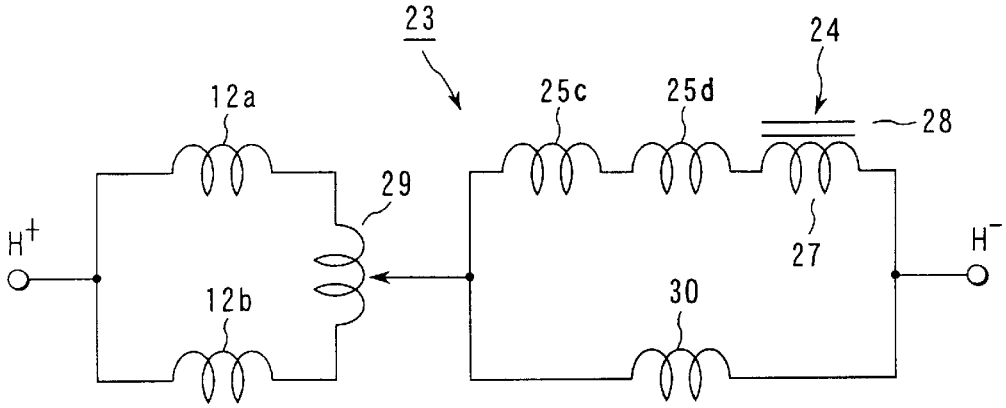
FIG. 5 is a circuit diagram showing the compensation mechanism incorporated in the deflection yoke of FIG. 4.

As shown in FIGS. 4 and 5, the compensation mechanism 23 of this embodiment also comprises a pair of auxiliary coils 25*c* and 25*d* through which a current flows in synchronism with horizontal deflection, and a control element 24 for controlling a current flowing through the auxiliary coils 25*c* and 25*d* in accordance with a change in the temperature of a pair of horizontal-deflection coils 12*a* and 12*b*.

As shown in FIGS. 4 and 5, the auxiliary coils 25*c* and 25*d* are provided adjacent to the pair of upper and lower horizontal-deflection coils 12*a* and 12*b*, respectively, and close to the horizontal axis (X-axis) of the coils 12*a* and 12*b*. The horizontal-deflection coils 12*a* and 12*b* generate a pincushion shape horizontal-deflection magnetic field 13, while the auxiliary coils 25*c* and 25*d* also generate a pin-cushion shape magnetic field 26*b*. The horizontal-deflection coils 12*a* and 12*b* and the auxiliary coils 25*c* and 25*d* form a magnetic field in which the difference between forces applied to a pair of side beams is appropriate.

The control element 24 is an inductance element comprising a coil 27 and a magnetic core 28, as is shown in FIG. 5. The magnetic core 28 of the control element 24 is made of a magnetic material that shows a larger change in magnetic permeability than the magnetic material of the core 6*a* of the deflection yoke 6 when the temperature changes.

The auxiliary coils 25*c* and 25*d* are connected in series to the control element 24 as shown in FIG. 5. The compensation mechanism 23 is connected to the horizontal-deflection coils 12*a* and 12*b* via a differential coil 29 interposed therebetween. Reference numeral 30 denotes a bypass coil connected parallel to the auxiliary coils 25*c* and 25*d*.

In the color cathode-ray tube apparatus having the compensation mechanism 23 constructed as the above, when the horizontal-deflection coils 12*a* and 12*b* have thermally expanded because of a temperature increase, the pincushion shape horizontal-deflection magnetic field 13, shown in FIG. 4, generated by the horizontal-deflection coils 12*a* and 12*b* weakens and changes into a shape relatively similar to the barrel-shape field. Accordingly, the difference between the forces of the horizontal-deflection magnetic field 13 applied to the side beams reduces, thereby increasing the degree of misconvergence Xh. At this time, the magnetic permeability of the magnetic core 28 of the control element 24 reduces because of the temperature increase, and hence the inductance of the element 24 reduces.

As a result, the impedance of the control element 24 reduces, and a horizontal-deflection current flowing into the element 24 increases. A current flowing into the auxiliary coils 25*c* and 25*d* connected in series to the control element 24 also increases. Accordingly, the pincushion-shape magnetic field 26*b*, shown in FIG. 4, generated by the auxiliary coils 25*c* and 25*d* strengthens, thereby compensating the weakened pincushion-shape horizontal-deflection magnetic field 13 generated by the horizontal-deflection coils 12*a* and 12*b* such that the difference between the forces applied to the side beams becomes appropriate. Thus, misconvergence Xh of the side beams is compensated.

Although, in the above-described embodiment, the auxiliary coils 25*c* and 25*d* are formed integral with or close to the horizontal-deflection coils 12*a* and 12*b* as shown in FIG. 4, they may be separated from the horizontal-deflection coils 12*a* and 12*b* and located closer to the horizontal axis (X-axis), or may be located closer to the vertical axis (Y-axis) than in the case of FIG. 4. It is sufficient if a magnetic field is synthesized, which will appropriately converge a pair of side beams on a horizontal peripheral portion of the screen.

A description will now be given of yet another compensation mechanism for use in the color cathode-ray tube apparatus of the invention.

Figure 6:
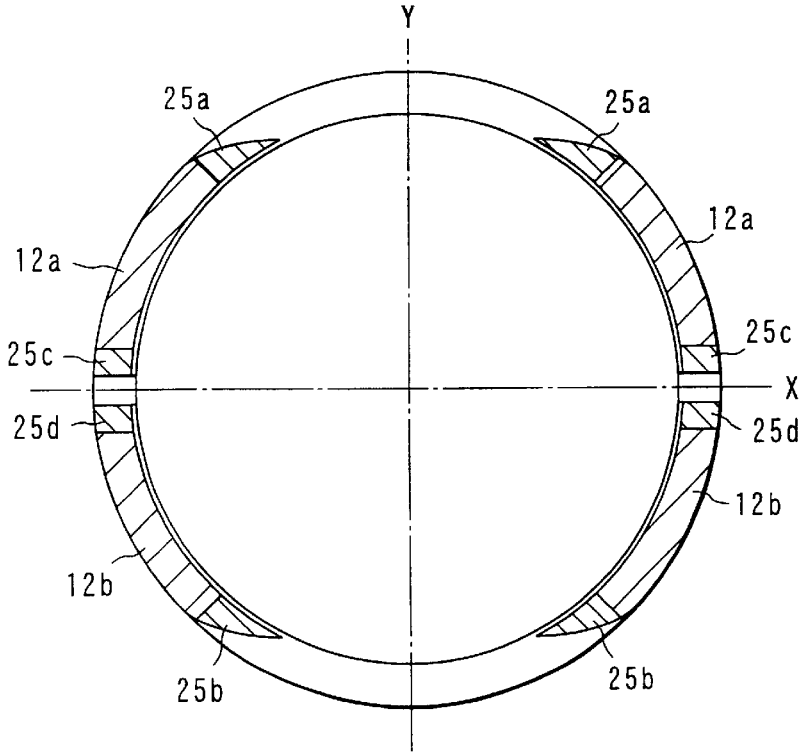
FIG. 6 is a sectional view illustrating a deflection yoke having a compensation mechanism, according to yet another embodiment of the invention.
Figure 7:
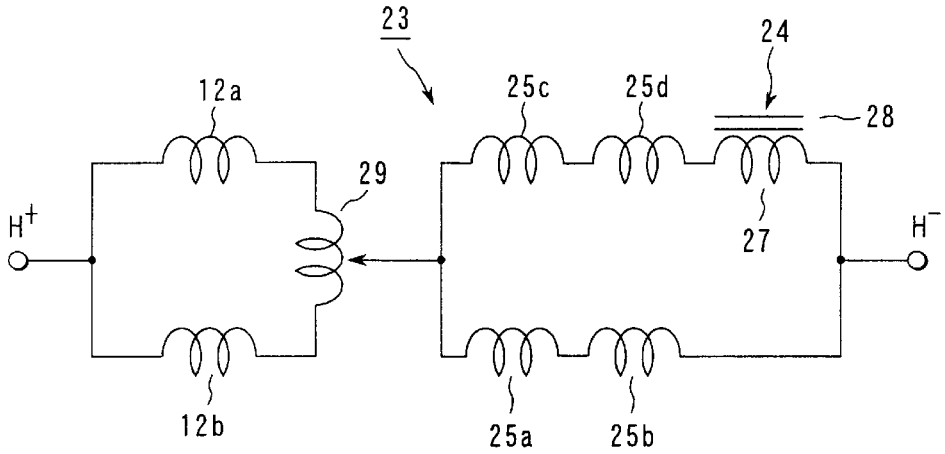
FIG. 7 is a circuit diagram showing the compensation mechanism incorporated in the deflection yoke of FIG. 6.
Figure 8:
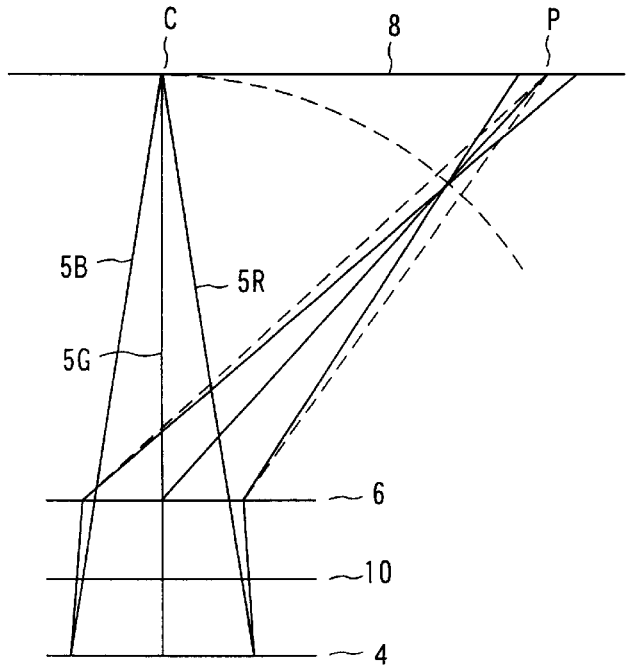
FIG. 8 is a view useful in explaining convergence of a pair of side beams on a phosphor screen.
Figure 9:
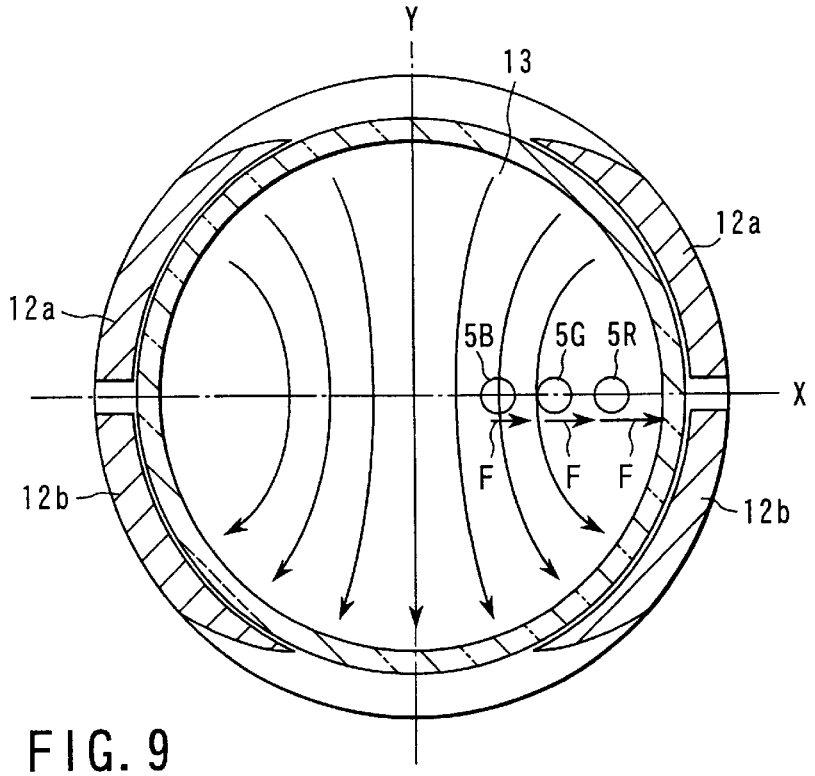
FIG. 9 (PRIOR ART)
FIG. 9 is a sectional view illustrating the structure of a deflection yoke incorporated in a conventional color cathode-ray tube apparatus.
Figure 10:
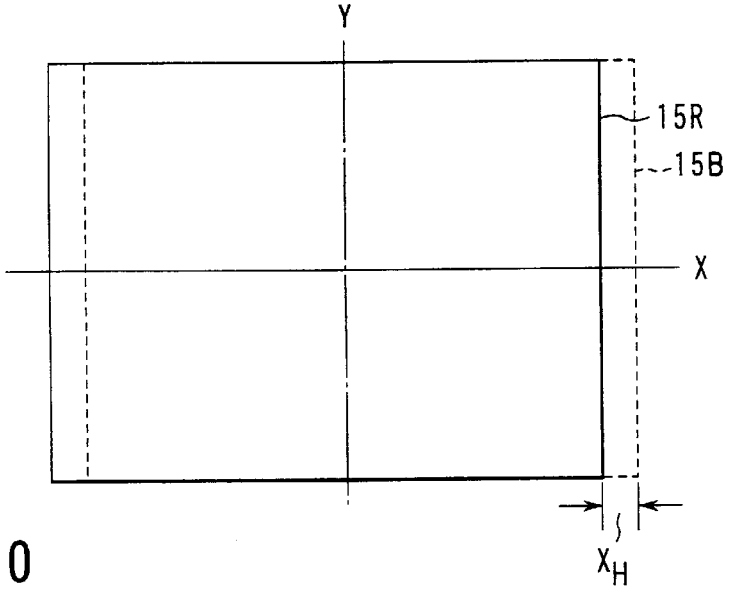
FIG. 10 is a view useful in explaining misconvergence of a pair of side beams due to thermal expansion of horizontal-deflection coils.

As shown in FIGS. 6 and 7, the compensation mechanism 23 of this embodiment comprises two pairs of auxiliary coils 25*a*, 25*b*, 25*c* and 25*d* through which a current flows in synchronism with horizontal deflection, and a control element 24 for controlling a current flowing through the auxiliary coils in accordance with a change in the temperature of a pair of horizontal-deflection coils 12*a* and 12*b*.

The auxiliary coils 25*a* and 25*b* are provided adjacent to the pair of upper and lower horizontal-deflection coils 12*a* and 12*b*, respectively, and close to the vertical axis of the coils 12*a* and 12*b*. The auxiliary coils 25*a* and 25*b* generate a barrel-shape magnetic field 26*a*.

The other auxiliary coils 25*c* and 25*d* are provided adjacent to the pair of upper and lower horizontal-deflection coils 12*a* and 12*b*, respectively, and close to the horizontal axis of the coils 12*a* and 12*b*. The auxiliary coils 25*c* and 25*d* also generate a pincushion shape magnetic field 26*b*. The horizontal-deflection coils 12*a* and 12*b* and the auxiliary coils 25*a*, 25*b*, 25*c* and 25*d* form a magnetic field in which the difference between forces applied to a pair of side beams is appropriate.

The control element 24 is an inductance element comprising a coil 27 and a magnetic core 28, as is shown in FIG. 7. The magnetic core 28 of the control element 24 is made of a magnetic material that shows a larger change in magnetic permeability than the magnetic material of the core 6*a* of the deflection yoke 6 when the temperature changes.

As shown in FIG. 7, the auxiliary coils 25*a* and 25*b* are connected parallel to the auxiliary coils 25*c* and 25*d*. Further, the control element 24 is connected parallel to the auxiliary coils 25*a* and 25*b*, and connected in series to the auxiliary coils 25*c* and 25*d*. The compensation mechanism 23 is connected to the horizontal-deflection coils 12*a* and 12*b* via a differential coil 29 interposed therebetween.

In the color cathode-ray tube apparatus having the compensation mechanism 23 constructed as the above, when the horizontal-deflection coils 12*a* and 12*b* have thermally expanded because of a temperature increase, the pincushion shape horizontal-deflection magnetic field 13, shown in FIG. 6, generated by the horizontal-deflection coils 12*a* and 12*b* weakens. Accordingly, the horizontal-deflection magnetic field 13 varies in a direction in which the difference between the forces applied to the side beams reduces. At this time, the magnetic permeability of the magnetic core 28 of the control element 24 reduces because of the temperature increase, and hence the inductance of the element 24 reduces.

As a result, the impedance of the control element 24 reduces, and a horizontal-deflection current flowing into the element 24 increases. On the other hand, a current flowing into the auxiliary coils 25*a* and 25*b* connected parallel to the control element 24 reduces. Further, a current flowing into the auxiliary coils 25*c* and 25*d* connected in series to the control element 24 increases. Accordingly, the barrel-shape magnetic field 26*a* generated by the auxiliary coils 25*a* and 25*b* weakens, while the pincushion shape magnetic field 26*b* generated by the auxiliary coils 25*c* and 25*d* strengthens. A non-uniform magnetic field formed by the auxiliary coils 25*a*, 25*b*, 25*c* and 25*d* compensates the weakened pincushion-shape horizontal-deflection magnetic field 13 generated by the horizontal-deflection coils 12*a* and 12*b*, such that the difference between the forces applied to the side beams becomes appropriate. Thus, misconvergence Xh of the side beams is compensated.

Although, in the above-described embodiment, the auxiliary coils 25*a*, 25*b*, 25*c* and 25*d* are formed integral with or close to the horizontal-deflection coils 12*a* and 12*b* as shown in FIG. 6, they may be separated from the horizontal-deflection coils 12*a* and 12*b* and located closer to the horizontal axis (X-axis) or the vertical axis (Y-axis), or may be located closer to the vertical axis (Y-axis) or the horizontal axis (X-axis) than in the case of FIG. 6. It is sufficient if a magnetic field is synthesized, which will appropriately converge a pair of side beams on a horizontal peripheral portion of the screen.

As described above, in this invention, the compensation mechanism comprises the auxiliary coils through which a current flows in synchronism with horizontal deflection, and the control element for controlling a current flowing through the auxiliary coils in accordance with a change in the temperature of the horizontal-deflection coils. Accordingly, misconvergence of a pair of side beams can be compensated, which will occur when the shape of the horizontal-deflection magnetic field changes because of thermal expansion of the horizontal-deflection coils due to an increase in the temperature of the deflection yoke. This enables the provision of a color cathode-ray tube apparatus capable of displaying an image that is not significantly influenced by a change in temperature.

Although, in the above-described embodiments, the auxiliary coils of the compensation mechanism are located near the horizontal-deflection coils, the location and/or the shape of each auxiliary coil is not limited to the above. It is sufficient if the auxiliary coils generate a non-uniform magnetic field in an area where a pair of side beams passes through.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube apparatus having a pair of horizontal-deflection coils for generating a horizontal-deflection magnetic field that horizontally deflects a plurality of electron beams emitted from an electron gun assembly, comprising:

compensation means for generating a magnetic field that compensates a change in the horizontal-deflection magnetic field due to a change in a temperature of the horizontal-deflection coils, the compensation means having auxiliary coils to which a current is supplied in synchronism with horizontal deflection of the electron beams, and a control element for controlling the current supplied to the auxiliary coils in accordance with a change in the temperature of the horizontal-deflection coils.

2. The color cathode-ray tube apparatus according to claim 1, wherein the auxiliary coils are provided close to a vertical axis of the horizontal-deflection coils, and the control element is connected parallel to the auxiliary coils.

3. The color cathode-ray tube apparatus according to claim 1, wherein the auxiliary coils are provided close to a horizontal axis of the horizontal-deflection coils, and the control element is connected in series to the auxiliary coils.

4. The color cathode-ray tube apparatus according to claim 1, wherein the auxiliary coils includes first coils provided close to a vertical axis of the horizontal-deflection coils, and second coils provided close to a horizontal axis of the horizontal-deflection coils, and the control element is connected parallel to the first coils and connected in series to the second coils.

5. The color cathode-ray tube apparatus according to claim 4, wherein the auxiliary coils generate a non-uniform magnetic field.

6. A color cathode-ray tube apparatus having an electron gun assembly for emitting a plurality of electron beams, and a deflection yoke having horizontal-deflection coils and vertical-deflection coils for horizontally and vertically deflects the plurality of electron beams emitted from the electron gun assembly, comprising:

compensation means for generating a magnetic field that compensates a change in the horizontal-deflection magnetic field due to a change in a temperature of the horizontal-deflection coils, the compensation means having auxiliary coils to which a current is supplied in synchronism with horizontal deflection of the electron beams, and a control element for controlling the current supplied to the auxiliary coils in accordance with a change in the temperature of the horizontal-deflection coils, the control element being an inductance element that includes a coil, and a magnetic core made of a magnetic material that shows a larger change in magnetic permeability than a magnetic material of a core section of the deflection yoke when the temperature changes.

7. A color cathode-ray tube apparatus having a pair of horizontal-deflection coils for generating a horizontal-deflection magnetic field that horizontally deflects a plurality of electron beams emitted form a electron gun assembly comprising:

compensation means, connected in series to a pair of horizontal-deflection coils, for generating a magnetic field that compensates a change in the horizontal-deflection magnetic field due to a change in a temperature of the horizontal-deflection coils, the compensation means having auxiliary coils to which a current is supplied in synchronism with horizontal deflection of the electron beams, and a control element for controlling the current supplied to the auxiliary coils in accordance with a change in the temperature of the horizontal-deflection coils, and the compensation means generating a magnetic field for compensating the horizontal-deflection magnetic field generated by the horizontal-deflection coil which weakens as temperature increases.

8. The color cathode-ray tube apparatus according to claim 7, wherein the auxiliary coils are provided to close to a vertical axis of the horizontal-deflection coils, and the control element is connected parallel to the auxiliary coils.

9. The color cathode-ray tube apparatus according to claim 7, wherein the auxiliary coils are provided close to a horizontal axis of the horizontal-deflection coils, and the control element is connected in series to the auxiliary coils.

10. The color cathode-ray tube apparatus according to claim 7, wherein the auxiliary coils includes first coils provided close to a vertical axis of the horizontal-deflection coils, and second coils provided close to a horizontal axis of the horizontal-deflection coils, and the control element is connect parallel to the first coils and connected in series to the second coils.

11. The color cathode-ray tube apparatus according to claim 10, wherein the auxiliary coils generate a non-uniform magnetic field.

* * * * *

UNITED STATES PATENT AND TRADEMARK OFFICE

CERTIFICATE OF CORRECTION

PATENT NO. : 6,686,688 B2
DATED : February 3, 2004
INVENTOR(S) : Yutaka Fukuda

It is certified that error appears in the above-identified patent and that said Letters Patent is hereby corrected as shown below:

Title page,
Item [54], Title, replace "COLOR CATHODE-RAY TUBE APPARATUS" with -- CRT ARRANGEMENT COMPENSATING MISCONVERGENCE OF SIDE BEAMS --.

Signed and Sealed this

Twenty-ninth Day of June, 2004

JON W. DUDAS
*Acting Director of the United States Patent and Trademark Office*